US009797085B2

(12) United States Patent
Lee

(10) Patent No.: US 9,797,085 B2
(45) Date of Patent: Oct. 24, 2017

(54) WALL-MOUNTED DRUM WASHING MACHINE

(71) Applicant: Dongbu Daewoo Electronics Corporation, Seoul (KR)

(72) Inventor: Jae Woo Lee, Incheon (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 573 days.

(21) Appl. No.: 13/958,482

(22) Filed: Aug. 2, 2013

(65) Prior Publication Data

US 2013/0327100 A1 Dec. 12, 2013

(30) Foreign Application Priority Data

Aug. 6, 2012 (KR) ..... 10-2012-0085758

(51) Int. Cl.
*D06F 39/08* (2006.01)
*D06F 37/26* (2006.01)

(52) U.S. Cl.
CPC ..... *D06F 39/083* (2013.01); *D06F 37/267* (2013.01)

(58) Field of Classification Search
CPC ..... D06F 39/12; D06F 39/125; D06F 1/02; D06F 21/02; D06F 21/04; D06F 23/02; D06F 37/04; D06F 37/20; D06F 37/22; D06F 37/26; D06F 37/267
See application file for complete search history.

(56) References Cited

U.S. PATENT DOCUMENTS

| | | | | |
|---|---|---|---|---|
| 2,431,925 A | | 12/1947 | Ehrling | |
| 2,660,870 A | | 12/1953 | Kennedy | |
| 2,677,950 A | | 5/1954 | Douglas | |
| 2,867,106 A | | 1/1959 | Stone, Jr. et al. | |
| 2,969,216 A | * | 1/1961 | Hallsey | F16L 3/2332 24/16 PB |
| 2,986,915 A | | 6/1961 | Nau | |

(Continued)

FOREIGN PATENT DOCUMENTS

| | | |
|---|---|---|
| EP | 2025794 A1 | 2/2009 |
| EP | 2312043 A1 | 4/2011 |

(Continued)

OTHER PUBLICATIONS

Herve Ponte, Espacenet Bibliographic Data: Abstract of EP2312043 (A1), Apr. 20, 2011, 1 page, European Patent Office, http://worldwide.espacenet.com.

(Continued)

*Primary Examiner* — David Cormier

(57) ABSTRACT

A wall-mounted drum washing machine includes: a rear panel mounted on a wall; a tub supported by the rear panel and containing washing water; a front panel having an opening formed therein and installed on the tub; a drum rotatably installed in the tub; a driving unit configured to providing power to the drum; a cover installed on the rear panel and covering the tub and the front panel; a water supply device supplying washing water to the tub; a drain device discharging washing water from the tub to the outside; and a ventilation device forming a flow path through which air is moved between the inside and outside of the tub and connected to the drain device so as to discharge bubbles introduced from the tub to the outside through the drain device.

7 Claims, 8 Drawing Sheets

(56) References Cited

U.S. PATENT DOCUMENTS

| | | | | |
|---|---|---|---|---|
| 3,064,361 | A | 11/1962 | Turner | |
| 3,103,112 | A | 9/1963 | Behrens et al. | |
| 3,383,776 | A | 5/1968 | Wilhoyte | |
| 3,471,940 | A | 10/1969 | Smith | |
| 4,868,998 | A | 9/1989 | Rubin | |
| 5,388,344 | A | 2/1995 | Wallach | |
| 5,421,175 | A | 6/1995 | Niu | |
| 5,443,538 | A | 8/1995 | Little | |
| 5,568,691 | A | 10/1996 | Rubin | |
| 5,946,814 | A | 9/1999 | Farrant | |
| 6,195,910 | B1 | 3/2001 | Robineau | |
| 7,213,349 | B1 | 5/2007 | Brunner | |
| 7,591,155 | B2 | 9/2009 | Chang | |
| 2002/0134118 | A1 | 9/2002 | Peachee et al. | |
| 2004/0194514 | A1 | 10/2004 | No et al. | |
| 2004/0237603 | A1 | 12/2004 | Kim et al. | |
| 2005/0103063 | A1 | 5/2005 | Namkung et al. | |
| 2006/0086155 | A1 | 4/2006 | Kim et al. | |
| 2008/0092601 | A1* | 4/2008 | Konides | D06F 5/001 68/13 R |
| 2009/0178442 | A1* | 7/2009 | Kawabata | D06F 9/083 68/20 |
| 2009/0260404 | A1 | 10/2009 | Saito et al. | |
| 2011/0036127 | A1 | 2/2011 | Lee | |
| 2012/0017652 | A1 | 1/2012 | Kwon et al. | |
| 2012/0233873 | A1 | 9/2012 | Del Pos et al. | |
| 2012/0233876 | A1 | 9/2012 | Weldon et al. | |
| 2012/0242205 | A1 | 9/2012 | Del Pos et al. | |
| 2013/0025330 | A1 | 1/2013 | Bae et al. | |
| 2014/0366587 | A1 | 12/2014 | Kegler et al. | |

FOREIGN PATENT DOCUMENTS

| | | | | |
|---|---|---|---|---|
| EP | 2317002 | A1 | 5/2011 | |
| IT | WO 2011051184 | A1 * | 5/2011 | D06F 39/125 |

OTHER PUBLICATIONS

European Search Report, EP Appl. No. 13178852.3-1710, Dec. 11, 2013, 4 pages, European Patent Office.

* cited by examiner

WALL-MOUNTED DRUM WASHING MACHINE

CROSS-REFERENCES TO RELATED APPLICATIONS

The present application claims priority to Korean application number 10-2012-0085758, filed on Aug. 6. 2012, which is incorporated by reference in its entirety.

BACKGROUND OF THE INVENTION

The present invention relates to a wall-mounted drum washing machine, and more particularly, to a wall-mounted drum washing machine which may be used in a state where it is mounted on the wall.

A general wall-mounted drum washing machine includes a cabinet, a tub movably installed in the cabinet and containing water, a drum rotatably installed in the tub and housing laundry, a driving unit to provide power to the drum, a water supply device supplying washing water to the tub, and a drain device discharging washing water from the tub to the outside of the cabinet.

When a user puts laundry into the drum and starts a washing process, washing water is supplied into the tub and the drum by the operation of the water supply device, and the washing process is started while the drum is rotated by the operation of the driving unit.

After the washing process is ended, the washing water having been contained in the tub and the drum is discharged to the outside of the cabinet through the drain device by the operation of the drain device.

Utility Model Registration Notification No. 20-0305578 published on Feb. 26, 2003 has disclosed a wall drum washing machine.

When an excessive amount of detergent is put into the washing machine, an excessive amount of bubbles may be formed in the tub so as to overflow from the tub. In washing machines having a small volume, such as a wall-mounted drum washing machine, such a phenomenon frequently occurs.

Thus, a structure capable of solving the problem is required.

SUMMARY OF THE INVENTION

Embodiments of the present invention are directed to a wall-mounted drum washing machine capable of discharging an excessive amount of bubbles formed in a tub through a drain device.

In one embodiment, a wall-mounted drum washing machine includes: a rear panel mounted on a wall; a tub supported by the rear panel and containing washing water; a front panel having an opening formed therein and installed on the tub; a drum rotatably installed in the tub; a driving unit configured to providing power to the drum; a cover installed on the rear panel and covering the tub and the front panel; a water supply device supplying washing water to the tub; a drain device discharging washing water from the tub to the outside; and a ventilation device forming a flow path through which air is moved between the inside and outside of the tub and connected to the drain device so as to discharge bubbles introduced from the tub to the outside through the drain device.

The drain device may include: a drain hole formed at the bottom of the tub; a drain pump installed under the tub and forcibly discharging the washing water within the tub through the drain hole; and a drain pipe having one end connected to the drain pump, and extended to the outside through the rear panel.

The wall-mounted drum washing machine may further include a drain pipe guide unit guiding the drain pipe to one side of the rear panel.

The drain pipe guide unit may include: a through-hole which is formed in the rear panel and through which the drain pipe passes; and a bottom through-groove which is formed at the bottom of the rear panel such that the drain pipe extended to the rear side of the rear panel through the through-hole is extended to the outside through the bottom through-groove.

The ventilation device may include: an air discharge hole formed in the rear panel and communicating with the inside of the tub; and a bubble discharge pipe having one end connected to the air discharge hole and the other end connected to the drain pipe.

The ventilation device may further include a ventilation pipe having one end connected to the bubble discharge pipe and the other end extended to a position at a higher level than the connection to the bubble discharge pipe.

The connection between the ventilation pipe and the bubble discharge pipe may be installed more adjacent to the air discharge hole than the drain pipe.

The wall-mounted drum washing machine may further include a ventilation pipe guide unit guiding the bubble discharge pipe to the bottom side of the rear panel and guiding the ventilation pipe to the other side of the rear panel.

The ventilation pipe guide unit may guide the ventilation pipe toward the top of the rear panel.

The ventilation pipe guide unit may include: a cable member wound around the circumference of one or more of the bubble discharge pipe and the ventilation pipe; and a cable fixing unit having a coupling groove to which a coupling member is coupled, and the cable member may be fixed between the coupling member and the cable fixing unit.

DESCRIPTION OF SPECIFIC EMBODIMENTS

Hereinafter, embodiments of the present invention will be described with reference to accompanying drawings. However, the embodiments are for illustrative purposes only and are not intended to limit the scope of the invention.

Figure 1:
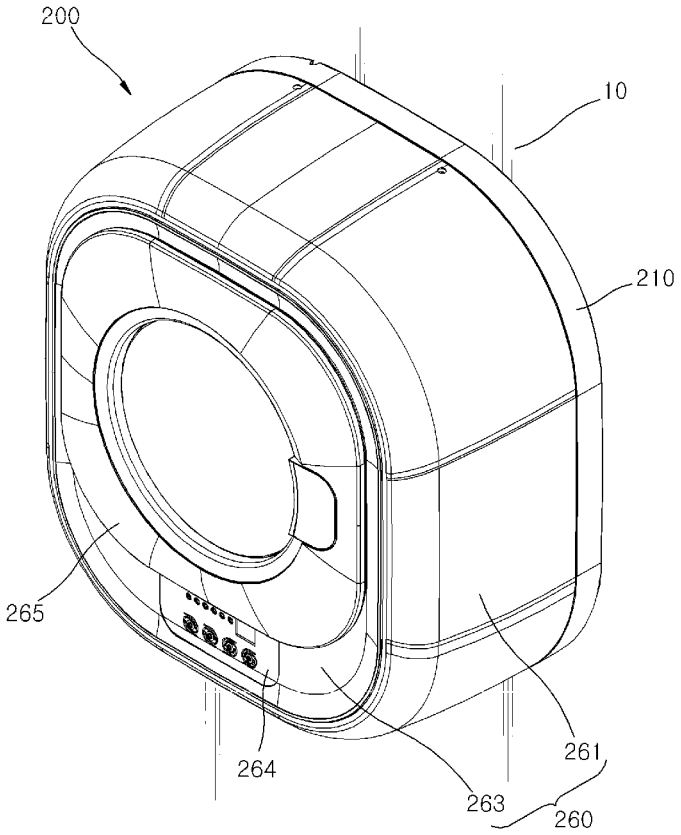
FIG. 1 is a perspective view of a wall-mounted drum washing machine in accordance with an embodiment of the present invention, when seen from the front side.
Figure 2:
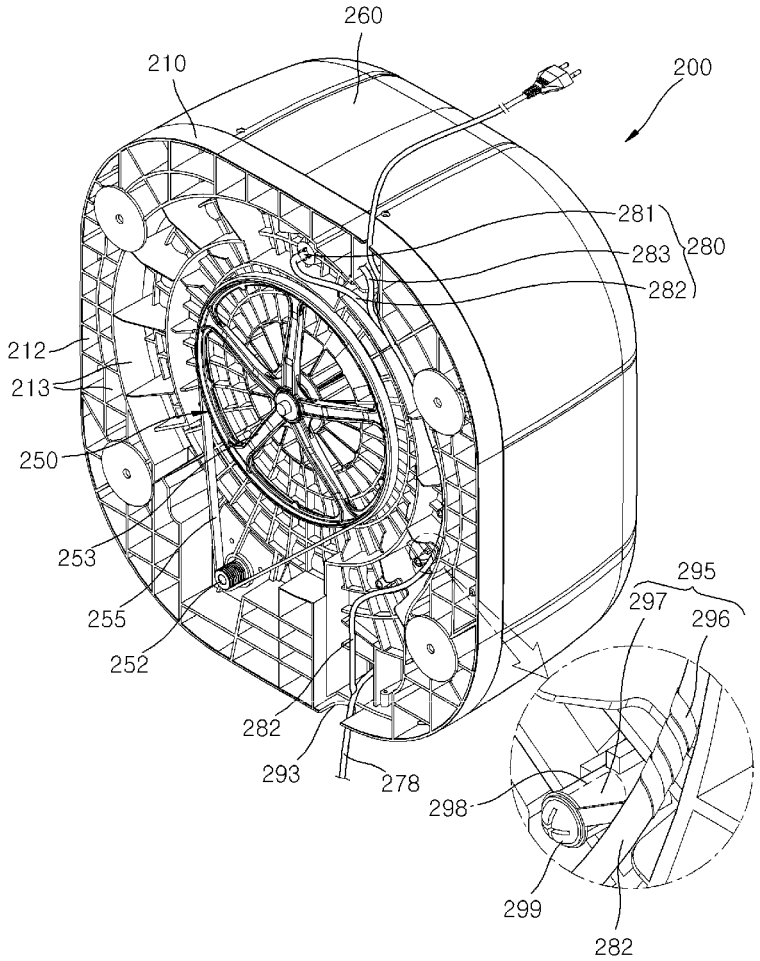
FIG. 2 is a perspective view of the wall-mounted drum washing machine in accordance with the embodiment of the present invention, when seen from the rear side.

FIG. 1 is a perspective view of a wall-mounted drum washing machine in accordance with an embodiment of the present invention, when seen from the front side. FIG. 2 is a perspective view of the wall-mounted drum washing machine in accordance with the embodiment of the present invention, when seen from the rear side.

Figure 3:
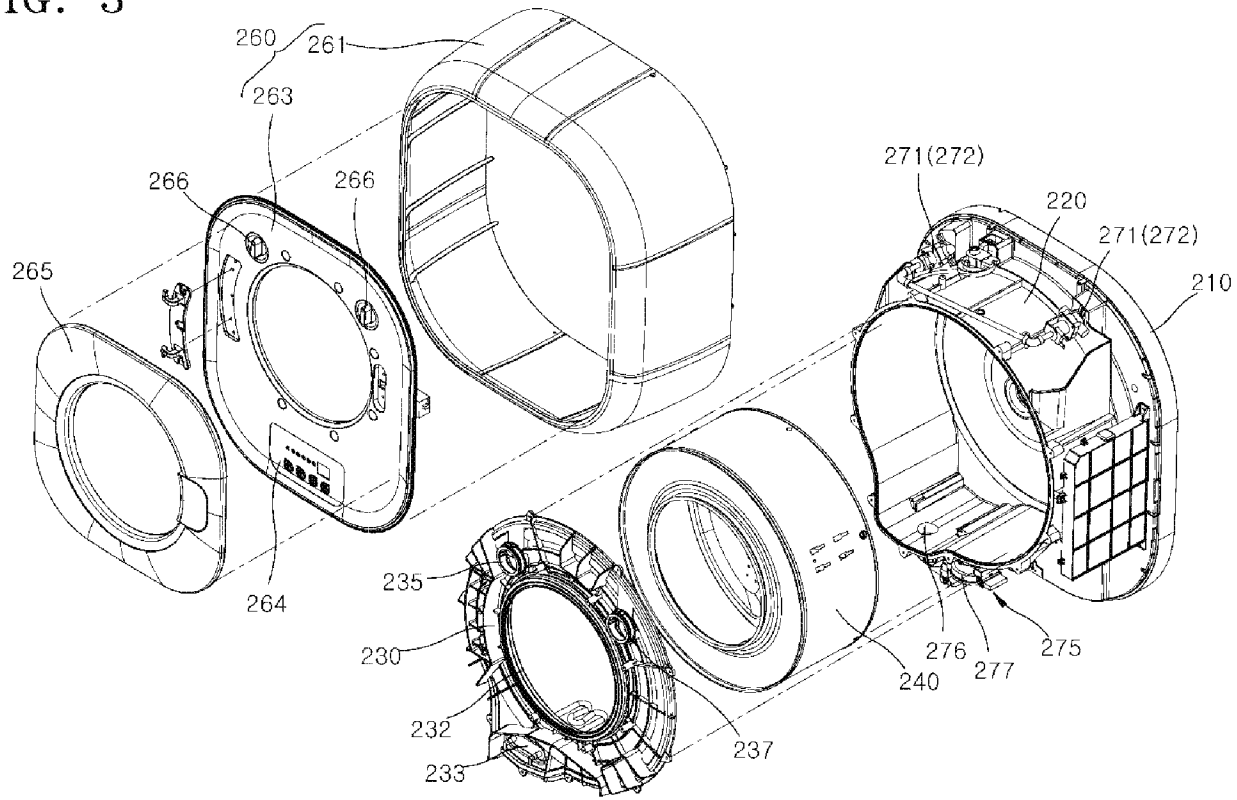
FIG. 3 is an exploded perspective view of the wall-mounted drum washing machine in accordance with the embodiment of the present invention.
Figure 4:
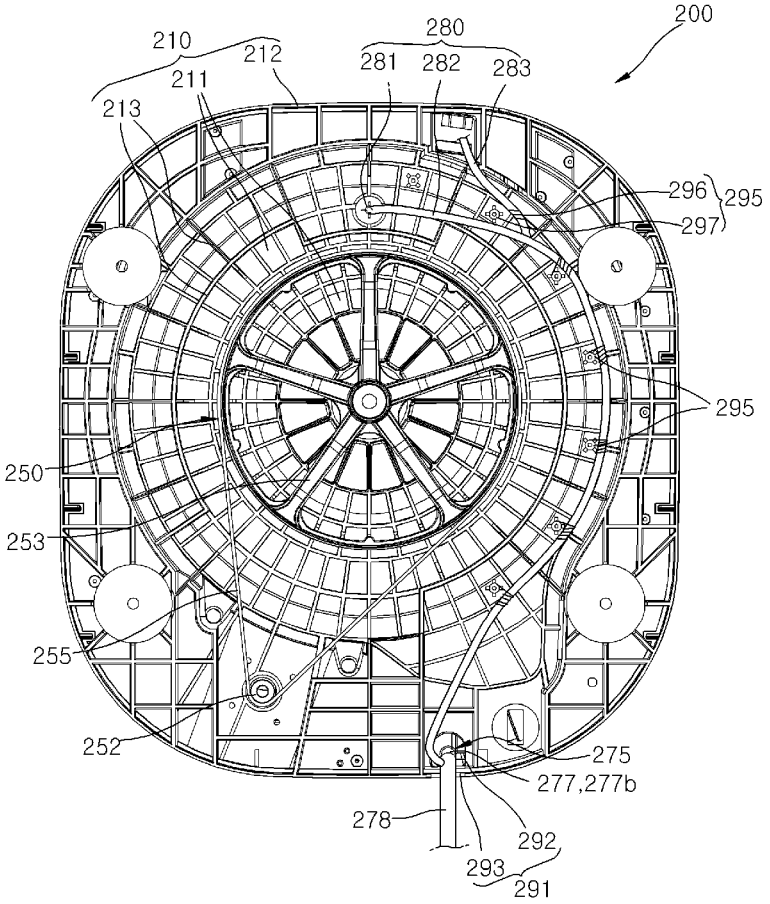
FIG. 4 is a rear view of the wall-mounted drum washing machine in accordance with the embodiment of the present invention.

FIG. 3 is an exploded perspective view of the wall-mounted drum washing machine in accordance with the embodiment of the present invention. FIG. 4 is a rear view of the wall-mounted drum washing machine in accordance with the embodiment of the present invention.

Figure 5:
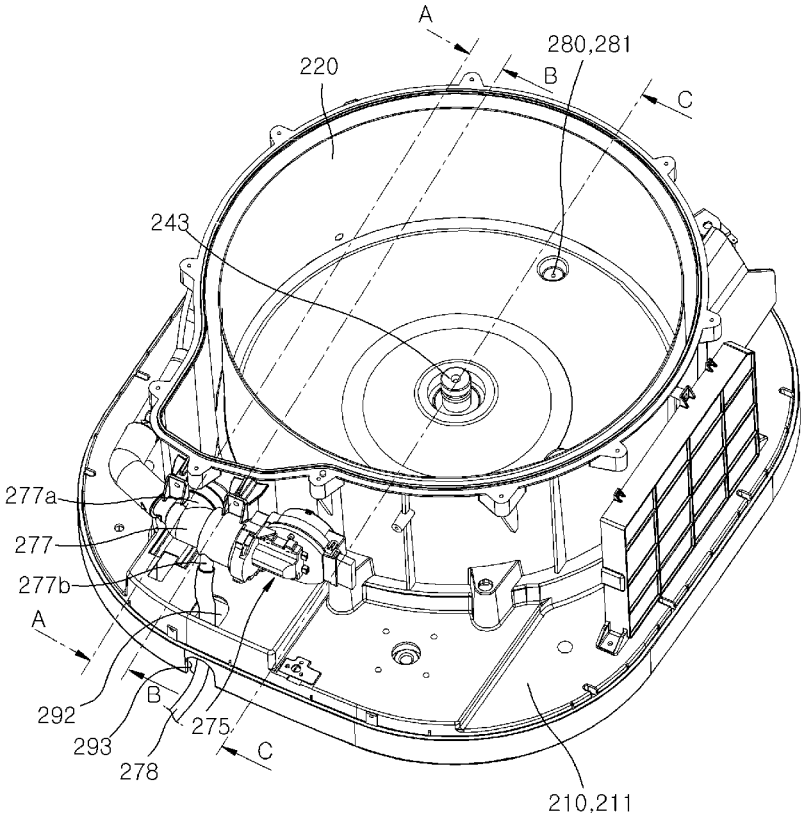
FIG. 5 is a perspective view of a drain device and a ventilation device of the wall-mounted drum washing machine in accordance with the embodiment of the present invention.
Figure 6:
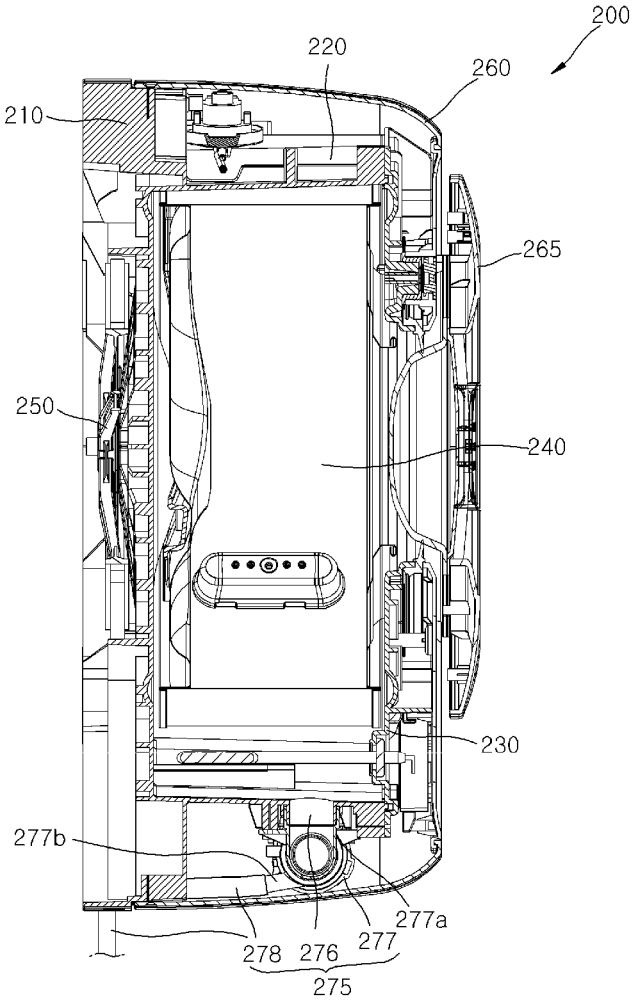
FIG. 6 is a cross-sectional view of the wall-mounted drum washing machine in accordance with the embodiment of the present invention, taken along line A-A of FIG. 5.

FIG. 5 is a perspective view of a drain device and a ventilation device of the wall-mounted drum washing machine in accordance with the embodiment of the present invention. FIG. 6 is a cross-sectional view of the wall-mounted drum washing machine in accordance with the embodiment of the present invention, taken along line A-A of FIG. 5.

Figure 7:
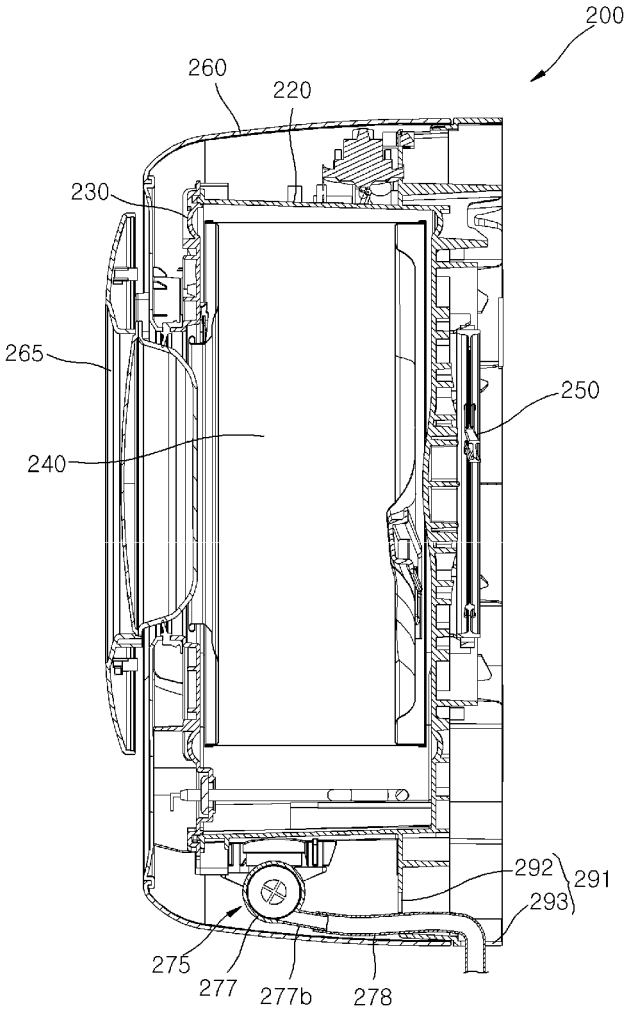
FIG. 7 is a cross-sectional view of the wall-mounted drum washing machine in accordance with the embodiment of the present invention, taken along line B-B of FIG. 5.
Figure 8:
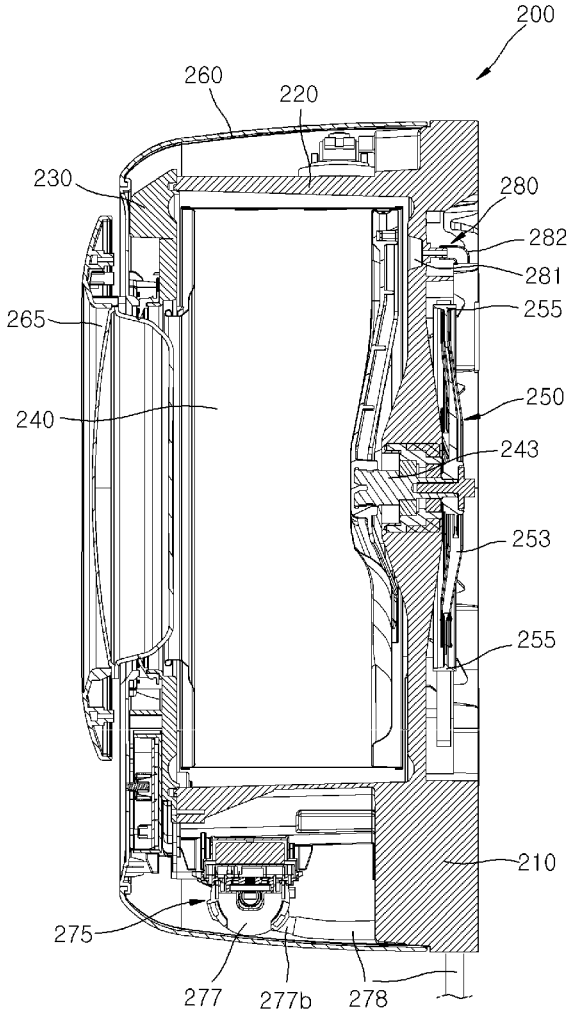
FIG. 8 is a cross-sectional view of the wall-mounted drum washing machine in accordance with the embodiment of the present invention, taken along line C-C of FIG. 5.

FIG. 7 is a cross-sectional view of the wall-mounted drum washing machine in accordance with the embodiment of the present invention, taken along line B-B of FIG. 5. FIG. 8 is a cross-sectional view of the wall-mounted drum washing machine in accordance with the embodiment of the present invention, taken along line C-C of FIG. 5.

Referring to FIGS. 1 to 4, the wall-mounted drum washing machine in accordance with the embodiment of the present invention includes a rear panel 210, a tub 220, a front panel 230, a drum 240, a driving unit 250, a cover 260, a water supply device 271, a drain device 275, a ventilation device 280, a drain pipe guide unit 291, and a ventilation pipe guide unit 295.

The rear panel 210 having a panel shape is mounted on a wall 10.

In the embodiment of the present invention, the rear panel 210 has a rectangular panel shape of which each corner has a curved portion, but is not limited thereto. Thus, the rear panel 210 may be modified into a circular shape or elliptical shape.

The rear panel 210 includes a panel portion 211, a circumference portion 212, and a rib portion 213.

The panel portion 211 has a panel shape extended in parallel to the wall surface of the wall 10.

The circumference portion 212 is formed to protrude from the edge of the panel portion 211 toward the wall, and a space is formed between the panel portion 211 and the wall 10 by the circumference portion 212.

The rib portion 213 includes a plurality of ribs formed on the rear surface of the panel portion 211 in the space between the panel portion 211 and the wall 10.

Since the strength of the rear panel 210 is reinforced by the rib portion 213, the rear panel 210 is prevented from being deformed or damaged by vibrations generated through rotations of the drum 240.

The tub 220 is supported by the rear panel 210 and contains washing water.

In the embodiment of the present invention, the tub 220 having a cylindrical shape is integrated and connected to the front surface of the rear panel 210, and formed to protrude forward from the front surface of the rear panel 210.

The front panel 230 has an opening 232 provided at a position corresponding to the opening of the tub 220 and is installed on the front surface of the tub 220.

The front panel 230 has a control unit 233 installed at the bottom thereof and a detergent box 235 and a conditioner box 237 installed at the top of thereof.

The control unit 233 is connected to a manipulation unit 264 formed on a cover portion 263 of the cover 260, and controls water supply, drainage, spin-drying, or rotations of the drum 240 according to a manipulation for the manipulation unit 264.

The drum 240 having a cylindrical shape is rotatably installed in the tub 220 and houses laundry therein.

The drum 240 has a driving shaft 243 rotatably installed in the rear panel 210, and the driving shaft 243 is connected to the driving unit 250 installed on the rear surface of the rear panel 210 through the panel portion 211.

The driving unit 250 provides power to the drum 240.

The driving unit 250 in accordance with the embodiment of the present invention includes a motor, a driving wheel 253, and a belt 255.

The motor is installed on the front surface of the rear panel 210, and has a rotating shaft 252 extended toward the rear surface of the rear panel 210 through the rear panel 210.

The driving wheel 253 is rotatably installed on the rear surface of the panel portion 211 in the space formed in the rear side of the panel portion 211, and connected to the driving shaft 243 of the drum 240.

The belt 255 transmits the power of the motor to the driving wheel 253.

One side of the belt 255 is wound around the circumference of the rotating shaft 252 of the motor, and the other side of the belt 255 is wound around the circumference of the driving wheel 253.

While the motor is driven, the rotary power of the motor is transmitted to the driving wheel 253 through the belt 255. While the drum 240 connected to the driving wheel 253 is rotated together, a washing process is performed.

The cover 260 is installed on the rear panel 210 so as to cover the tub 220 and the front panel 230, thereby constituting the exterior of the wall-mounted drum washing machine 200 in accordance with the embodiment of the present invention.

The cover 260 in accordance with the embodiment of the present invention includes a box portion 261 and a cover portion 263.

The box portion 261 is installed on the rear panel 210, and covers the circumference of the tub 220.

The cover portion 263 is coupled to the front surface of the box portion 261 so as to cover the front panel 230, and has a door 265 installed at a position corresponding to the opening 232.

The cover portion 263 has a manipulation unit 264 formed at the bottom thereof. The manipulation unit 264 includes manipulation buttons, a figure display device and the like, and is connected to a control unit 233.

The cover portion 263 has a stopper 266 installed at a position corresponding to the detergent box 235 and the conditioner box 237.

In a state where the stopper 266 is separated from the cover portion 263, the detergent box 235 and the conditioner box 237 may be pulled out of the front panel 230 or inserted into the front panel 230.

The water supply device 271 is coupled to the top of the rear panel 210, and supplies washing water into the tub 220.

The water supply device 271 according to the embodiment of the present invention includes a water supply valve 272 and a water supply pipe.

The water supply valve 272 controls a flow rate of the washing water supplied into the tub 220 through the water supply pipe.

One side of the water supply valve 272 is coupled to the top of the rear panel 210 and connected to the water supply pipe, and the other side of the water supply valve 272 is coupled to the tub 220 so as to supply the washing water received through the water supply pipe into the tub 220.

The water supply pipe is inserted into the circumference portion 212 from an external water supply source through a bottom through-groove 293 of the drain pipe guide unit 291, and extended to the top of the rear panel 210 so as to be connected to the water supply valve 272.

In the present embodiment, an extended path of the water supply pipe overlaps an extended path of a drain pipe 278 of the drain device 275 and a bubble discharge pipe 282 of the ventilation device 280. Thus, an illustration of the water supply pipe is omitted to clearly describe the drain pipe 278 and the bubble discharge pipe 282.

The drain device 275 discharges the washing water from the tub 220 to the outside of the wall-mounted drum washing machine 200 in accordance with the embodiment of the present invention, or specifically, to the outside of the cover 260 or the rear panel 210.

Referring to FIGS. 5 to 7, the drain device 275 in accordance with the embodiment of the present invention includes a drain hole 276, a drain pump 277, and a drain pipe 278.

The drain hole 276 is formed at the bottom of the tub 220, and the washing water within the tub 220 is discharged to the outside of the tub 220 through the drain hole 276.

The discharge pump 277 is installed under the tub 220 at a position corresponding to the drain hole 276.

Referring to FIGS. 3, 5, and 6, the top of the drain pump 277 is coupled to the bottom of the tub 220 and connected to communicate with the drain hole 276, and a rear end of the drain pump 277 facing the rear panel 210 is connected to the drain pipe 278.

That is, an introduction hole 277*a* of the drain pump 277 is connected to communicate with the drain hole 276, and a discharge hole 277*b* of the drain pump 277 faces the rear panel 210.

When the drain pump 277 is operated, the washing water within the tub 220 is forcibly discharged toward the discharge pipe 278 through the drain hole 276, and when the drain pump 277 is not operated, the drainage of the washing water is stopped.

Referring to FIGS. 5 and 7, the drain pipe 278 is connected to the drain pump 277, and extended to the outside of the wall-mounted drum washing machine 220 through the rear panel 210.

The drain pipe 278 is extended to the outside of the rear panel 210 through the through-hole 292 and the bottom through-groove 293 of the drain pipe guide unit 291.

The ventilation device 280 forms a flow path through which air is moved to the outside or inside of the tub 220.

When washing water is supplied into the tub 220 through the water supply device 271, air filled in the tub 220 is discharged to the outside of the tub 220 by the same volume as the supplied washing water through the ventilation device 280.

When the washing water within the tub 220 is discharged through the drain device 275, air outside the tub 220 is introduced into the tub 220 by the same volume as the discharged washing water through the ventilation device 280.

Bubbles formed in the tub 220 by the detergent put into the tub 220 are also discharged to the outside of the tub 220 through the ventilation device 280.

The ventilation device 280 is connected to the drain device 275 such that the bubbles introduced from the tub 220 are discharged to the outside through the drain device 275.

Referring to FIGS. 2, 4, 5, and 8, the ventilation device 280 in accordance with the embodiment of the present invention includes an air discharge hole 281, a bubble discharge pipe 282, and a ventilation pipe 283.

The air discharge hole 281 is formed at the top of the rear panel 210 so as to communicate with the inside of the tub 220. Among the bubbles formed in the tub 220, bubbles formed over the air discharge hole 281 are discharged to the outside of the tub 220 through the air discharge hole 281.

The bubble discharge pipe 282 connects the air discharge hole 281 and the discharge pipe 278.

One end of the bubble discharge pipe 282 is connected to the air discharge hole 281, and the other end of the bubble discharge pipe 282 is extended downward and connected to the drain pipe 278. The bubble discharge pipe 282 may be made of a flexible hose.

The bubbles introduced to the air discharge hole 281 are moved toward the discharge pipe 278 through the bubble discharge pipe 282, and discharged to the outside of the rear panel 210, that is, to the outside of the wall-mounted drum washing machine 200 through the discharge pipe 278.

The ventilation pipe 283 is connected to the bubble discharge pipe 282. The ventilation pipe 283 may be connected to the bubble discharge pipe 282 at a position more adjacent to the air discharge hole 281 than the drain pipe 278. That is, the connection portion between the ventilation pipe 283 and the bubble discharge pipe 282 may be positioned more adjacent to the air discharge hole 281 than the drain pipe 278.

When washing water is supplied into the tub 220, air filled in the tub 220 is introduced to the bubble discharge pipe 282 and discharged to the outside through the discharge pipe 283.

While the washing process is performed by the rotations of the drum 240 after the washing water is supplied, an excessive amount of bubbles may be formed to reach the air discharge hole 281. In this case, the bubbles are introduced to the bubble discharge pipe 282 and discharged to the outside through the discharge pipe 278.

When the washing water within the tub 220 is discharged while a drain process and a spin-drying process are performed after the washing process is completed, the air outside the tub 220 is introduced to the bubble discharge pipe 282 through the ventilation pipe 283 and introduced into the tub 220 through the air discharge hole 281.

One side of the ventilation pipe 283 is connected to the bubble discharge pipe 282, and the other side of the ventilation pipe 283 is installed to be extended to a position at a higher level than the one side of the ventilation pipe 283.

Thus, while a washing process is performed, bubbles moving downward toward the drain pipe 278 along the bubble discharge pipe 282 are not introduced to the ventilation pipe 283. That is, although the ventilation pipe 283 is connected to the bubble discharge pipe 282, the ventilation pipe 283 is extended toward a position at a higher level than the bubble discharge pipe 282. Thus, the bubbles moving toward the drain pipe 278 through the bubble discharge pipe 282 are not introduced to the ventilation pipe 283.

According to the ventilation device 280 having the above-described structure, the bubbles within the tub 220 may be discharged to the outside through the drain pipe 278, and may be prevented from leaking to the outside of the rear panel 210 through paths other than the drain pipe 278, for example, the ventilation pipe 283.

The drain pipe guide unit 291 guides the drain pipe 278 to one side of the rear panel 210, or specifically, to the bottom of the rear panel 210.

Referring to FIGS. 4, 5, and 7, the drain pipe guide unit 291 in accordance with the embodiment of the present invention includes the through-hole 292 and the bottom through-groove 293.

The through-hole 292 is formed through the panel portion 211 of the rear panel 210. The bottom through-groove 293 is formed at the bottom of the circumference portion 212 of the rear panel 210.

The drain pipe 278 connected to the drain pump 277 is extended to the rear side of the rear panel 210 through the through-hole 292, and extended downward to the outside of the rear panel 210 through the bottom through-groove 293.

The bottom through-groove 293 is formed to surround the drain pipe 278, thereby suppressing an excessive movement of the drain pipe 278. Thus, since the movement of the drain pipe 278 is limited by the wall 10 and the bottom through-groove 293, interference with other surrounding objects may be prevented.

The through-hole 292 is positioned at the same level as or lower level than the discharge hole 277*b* of the drain pump 277, and the bottom through-groove 293 is positioned at a lower level than the through-hole 292.

The drain pipe 278 is guided downward to the rear side and bottom side of the rear panel from the drain pump 277 while sequentially passing through the through-hole 292 and the bottom through-groove 293 having the above-described structure.

As the drain pipe 278 is installed to extend downward through the drain pipe guide unit 291, the washing water discharged from the tub 220 naturally moves downward along the drain pipe 278, and then stably moves to the outside of the tub 220. Thus, the washing water discharged from the tub 220 may be prevented from flowing back toward the drain pump 277.

The ventilation pipe guide unit 295 guides the bubble discharge pipe 282 downward toward the drain pipe 278, and guides the discharge pipe 283 upward.

Referring to FIGS. 2 and 4, the ventilation pipe guide unit 295 in accordance with the embodiment of the present invention includes a cable member 296 and a cable fixing unit 297.

The cable member 296 is wound around the circumference of one or more of the bubble discharge pipe 282 and the ventilation pipe 283. Thus, the cable member 296 may be wound only around the circumference of the bubble discharge pipe 282, wound only around the circumference of the ventilation pipe 283, or wound around the circumferences of the bubble discharge pipe 282 and the ventilation pipe 283.

The cable member 296 may be made of a wire member such as a steel wire, which maintains a shape formed by an external force.

The cable fixing unit 297 has a coupling groove 298 to which a coupling member 299 such as a bolt is coupled, and is formed to protrude from the rear surface of the panel portion 211.

At this time, a plurality of cable fixing units 297 may be disposed in a vertical direction at positions which do not correspond to the space in which the driving unit 250 is installed. Thus, the bubble discharge pipe 282 or the ventilation pipe 283 does not interfere with the driving unit 250.

The cable member 296 may be divided into one side and the other side. The one side of the cable member 296 is wound around the circumference of the bubble discharge pipe 282 or the ventilation pipe 283 so as to fasten the bubble discharge pipe 282 or the ventilation pipe 283. The other side of the cable member 296 is extended from the one side of the cable member 296, and fixed between the cable fixing unit 297 and the coupling member 299.

A user may fasten the bubble discharge pipe 282 or the ventilation pipe 283 through the one side of the cable member 296, and then couples the coupling member 299 to the coupling groove 298 in a state where the other side of the cable member 296 is disposed on the cable fixing unit 297. Then, the other side of the cable member 296 is fixed to the cable fixing unit 297 through the coupling member 299.

As the cable member 296 fastening the bubble discharge pipe 282 is fixed to the cable fixing unit 297, the bubble discharge pipe 282 extended to the bottom of the driving unit 250 from the top of the driving unit 250 may be prevented from being moved toward the driving unit 250.

Furthermore, as the cable member 296 fastening the ventilation pipe 283 is fixed to the cable fixing unit 297 positioned at the top of the rear panel 210, the ventilation pipe 283 may be stably fixed in such a shape as to extend upward from the bubble discharge pipe 282.

In accordance with the embodiment of the present invention, an excessive amount of bubbles formed in the tub may be discharged to the outside through the drain pipe of the drain device forming the washing water discharge path, and may be prevented from leaking to the outside the rear panel through the ventilation device.

Furthermore, since the movement of the drain pipe is limited by the wall and the bottom through-groove, interference between the drain pipe and other surrounding objects may be prevented.

Furthermore, since the drain pipe is installed to extend downward through the drain pipe guide unit, the washing water discharged from the tub naturally moves downward along the drain pipe. Thus, the washing water may be stably discharged to the outside of the tub, and the washing water discharged from the tub may be prevented from flowing back toward the drain pump.

Furthermore, since the bubble discharge pipe may be fixed to the cable fixing unit through the cable member, the bubble discharge pipe may be prevented from moving toward the driving unit and interfering with the driving unit.

Furthermore, since the ventilation pipe may be fixed to the cable fixing unit through the cable member, the ventilation pipe diverging from the bubble discharge pipe may be maintained in such a shape as to extend upward.

The embodiments of the present invention have been disclosed above for illustrative purposes. Those skilled in the art will appreciate that various modifications, additions and substitutions are possible, without departing from the scope and spirit of the invention as disclosed in the accompanying claims.

So far, the wall-mounted drum washing machine has been described, but is only an example. The drum washing machine in accordance with the embodiment of the present invention may be used to products other than the wall-mounted drum washing machine.

What is claimed is:

1. A wall-mounted drum washing machine comprising:

a rear panel mounted on a wall;

a tub supported by the rear panel and containing washing water;

a front panel having an opening therein and installed on the tub;

a drum rotatably installed in the tub;

a driving unit configured to provide power to the drum;

a cover on the rear panel and covering the tub and the front panel;

a water supply device supplying washing water to the tub;

a drain device discharging washing water from the tub to the outside; and a ventilation device forming a flow path through which air moves between inside the tub and outside the tub and connected to the drain device so as to discharge bubbles from the tub to the outside through the drain device, wherein the drain device comprises:

a drain hole at a bottom of the tub;

a drain pump under the tub and forcibly discharging the washing water within the tub through the drain hole; and a drain pipe having one end connected to the drain pump, and extending to the outside through the rear panel, wherein the wall-mounted drum washing machine further comprises a drain pipe guide unit guiding the drain pipe to one side of the rear panel, wherein the drain pipe guide unit comprises:

a through-hole in the rear panel and through which the drain pipe passes; and a bottom through-groove at a bottom of the rear panel such that the drain pipe passing through the through-hole extends to the outside through the bottom through-groove.

2. The wall-mounted drum washing machine of claim 1, wherein the ventilation device comprises:

an air discharge hole in the rear panel and communicating with the inside of the tub; and a bubble discharge pipe having one end connected to the air discharge hole and another end connected to the drain pipe.

3. The wall-mounted drum washing machine of claim 2, wherein the ventilation device further comprises a ventilation pipe having one end connected to the bubble discharge pipe and another end extending to a position at a higher level than a connection to the bubble discharge pipe.

4. The wall-mounted drum washing machine of claim 3, wherein the connection between the ventilation pipe and the bubble discharge pipe is closer to the air discharge hole than the drain pipe.

5. The wall-mounted drum washing machine of claim 3, further comprising a ventilation pipe guide unit guiding the bubble discharge pipe to a bottom side of the rear panel and guiding the ventilation pipe to the other side of the rear panel.

6. The wall-mounted drum washing machine of claim 5, wherein the ventilation pipe guide unit guides the ventilation pipe toward a top of the rear panel.

7. The wall-mounted drum washing machine of claim 6, wherein the ventilation pipe guide unit comprises:

a cable member wound around the circumference of one or more of the bubble discharge pipe and the ventilation pipe; and a cable fixing unit having a coupling groove to which a coupling member is coupled, and the cable member is fixed between the coupling member and the cable fixing unit.

* * * * *